US006586374B1

(12) United States Patent
Paul

(10) Patent No.: US 6,586,374 B1
(45) Date of Patent: Jul. 1, 2003

(54) ENGINEERED SYNTHETIC ENGINE OIL AND METHOD OF USE

(75) Inventor: Edward Alan Paul, Bedford, TX (US)

(73) Assignee: Primrose Oil Company, Dallas, TX (US)

( * ) Notice: Subject to any disclaimer, the term of this patent is extended or adjusted under 35 U.S.C. 154(b) by 0 days.

(21) Appl. No.: 10/198,527

(22) Filed: Jul. 18, 2002

(51) Int. Cl.[7] ..... C10M 161/00

(52) U.S. Cl. ..... 508/214; 508/409; 508/505; 508/506; 508/586; 508/591

(58) Field of Search ..... 508/591, 214, 508/409, 505, 506, 586; 585/10, 12, 18

(56) References Cited

U.S. PATENT DOCUMENTS 4,956,122 A * 9/1990 Watts et al. ..... 508/485
4,992,183 A * 2/1991 Beimesch et al. ..... 508/499
5,180,865 A * 1/1993 Heilman et al. ..... 585/10
5,436,379 A * 7/1995 Heilman et al. ..... 585/10
5,637,784 A * 6/1997 Chu et al. ..... 585/14
6,071,863 A * 6/2000 Benda et al. ..... 508/591
6,110,877 A * 8/2000 Roberts ..... 508/363
6,313,077 B1 11/2001 Stunnenberg et al. ..... 508/591
6,331,510 B1 * 12/2001 Curtis et al. ..... 508/578
6,399,550 B1 * 6/2002 Zehler ..... 508/501

* cited by examiner

*Primary Examiner*—Jacqueline V. Howard
(74) *Attorney, Agent, or Firm*—Locke Liddell & Sapp LLP; Monty L. Ross

(57) ABSTRACT

A synthetic lubricant for gasoline and diesel engines having a viscosity ranging between about 14.5 and 16.5 cs at 100° C., the lubricant containing from about 55 to about 75 volume percent polyalphaolefin having a viscosity of about 6 to 8 cs at 100° C., an ethylene-propylene copolymer, an ester or diester, a packaged additive, a total base number enhancer and a minor effective amount of an antifoamant. A method of use is also provided whereby the subject lubricant is recirculated through an operating engine while periodically monitoring the total base number and adjusting the total base number to a level of about 12.0 by the addition of a total base number enhancer such as calcium phenate.

36 Claims, No Drawings

ENGINEERED SYNTHETIC ENGINE OIL AND METHOD OF USE

BACKGROUND OF THE INVENTION

1. Field of the Invention

This invention relates to engine lubricating oils and, more particularly, to a composition for, and method of using, a custom formulated, engineered, full synthetic engine oil having a significantly longer service life, improved lubricity, lower operating cost, and fewer health, safety and environmental risks than conventional engine lubricants.

2. Description of Related Art

The use of engine lubricants in both gasoline and diesel engines is well known. Historically, virtually all engine lubricants consisted primarily of refined hydrocarbon oils into which additive packages were blended to achieve improved properties and service life as necessary to achieve certification by organizations such as the Society of Automotive Engineers (SAE). In recent years, the use of synthetic lubricating oils for gasoline engines has become more widespread. Generally speaking, the cost of synthetic oils is greater than for conventional mineral oil lubricants but synthetic oils offer improved lubricity, lower oil consumption, better engine protection and longer service life for both the lubricating oil and the engines in which it is used. With increased emphasis on the use of synthetic oils and resultant competition among suppliers, several different types of synthetic lubricants have emerged, some of which perform only marginally better than lubricants have emerged, some of which perform only marginally better than conventional oils and may not provide long term savings that justify the higher initial cost.

Full synthetic oils consist primarily of high quality synthetic polyalphaolefin ("PAO") base stocks and are typically priced much higher than conventional engine lube oils. Synthetic oils are now recommended for use in some automotive engines, particularly in high performance engines and those in luxury automobiles. Generally speaking, synthetic oils are viewed as having improved lubricity and longer service life when compared to conventional motor oils. However, because PAO base stocks are significantly more expensive than refined mineral oils, many consumers have resisted switching to synthetic oils because of cost.

As a result of price sensitivity on the part of consumers, many producers of so-called "synthetic" oils now manufacture and market blends in which more highly refined mineral oils are used in place of most, and in some cases all, of the PAO. The percentage of synthetic base stock in blended synthetic oils (sometimes referred to as "partial" synthetics) can vary, for example, from as little as about three weight percent in the lower grades up to about 30 weight percent in higher grade products, sometimes referred to as "engineered blends." Such blends lack many of the improved properties previously associated with full synthetic oils containing a high percentage of PAO. Also, these lower grade "synthetic" lubricants may produce byproducts that foul or otherwise inhibit engine performance during use.

Beyond automotive use, the need for effective engine lubricants for diesel engines is also well known. Large diesel engines are widely used in various oilfield, industrial and transportation applications. Such engines are normally expected to remain in continuous or substantially continuous service for long periods, utilize heavier and more contaminated fuels than gasoline engines, and are frequently operated under heavy loads. In such use environments, lubricating oils that demonstrate great lubricity, long service life, lower oil consumption, better engine protection and overall cost effectiveness are often critical to the success of the related venture. Lubricity is necessary for achieving mechanical efficiency, reduced engine wear and longer intervals between major overhauls. Extended service life is desirable to reduce the out-of-service time, labor and material costs associated with oil changes. Also, by reducing the total volume of lubricating oil required to service an engine over an extended period, other cost efficiencies such as lower freight, handling and storage costs are achieved. Furthermore, longer service life, fewer oil changes and reduced transportation and handling all contribute to less worker exposure to health and safety risks, and less chance of accidental leakage or spills that can adversely affect the environment.

Lubricating oils consisting primarily of petroleum refined mineral oil and various additive packages are normally used in large diesel engines. Some synthetic oils have previously been disclosed and certified for diesel engines but their use has not become widespread. This is believed to be primarily attributable to the relatively large lubricant capacities associated with diesel engines that, when coupled with the higher selling price of synthetic lubricants, has previously been viewed as more than offsetting any related cost advantages in service life or performance. Many operators have failed, however, to fully appreciate all the costs associated with using inferior lubricants.

Diesel engines such as those used to power generators on offshore drilling platforms, for example, often have oil pans or sumps containing more than a hundred gallons of lubricating oil. Such engines are sometimes operated for 5,000 to 7,000 hours in a single year. When using a conventional lubricating oil consisting primarily of mineral oil, oil changes may be required as often as every 1,000 hours, and even more often where the diesel fuel contains more than about 0.5 weight percent sulfur or where impurities and additives in the oil contribute to the formation of sludge or acidic byproducts.

The acidity of a lubricating oil generally increases with extended use over time. As oils become more acidic, they can corrode engine parts, cause loss of power and increased repair costs. Lubricating oils typically have a total base number ("TBN") in the range of about 8 to 10 when placed in service and are changed whenever the TBN drops to about 3 or 4. Where operators fail to maintain rigorous maintenance schedules and run engines with dirty or ineffective lubricant, significant engine wear can occur within relatively short periods, necessitating expensive overhauls and associated downtime.

An engineered, full synthetic lubricant is therefore needed that can be safely and effectively utilized in either gasoline or diesel-fueled engines and that will demonstrate superior performance and service life benefits which far surpass and justify any related increase in original purchase costs.

SUMMARY OF THE INVENTION

The lubricating oil disclosed herein is an engineered full PAO synthetic oil specially tailored for use as a high performance lubricant in gasoline and diesel engines. Engineered full synthetic oils are those made to the highest standards using the best PAO base stock available and are the most expensive and highest performing of the synthetic lubricating oils. These "full PAO" lubricants are designed rather than refined. As used herein, the term "full PAO"

refers to lubricants containing only PAO as the principal base stock component, although viscosity improvers and minor amounts of other additives are used to further enhance the lubricant properties. It should be understood, however, that minor amounts of refined mineral oil may be present in the lubricants of the invention as diluents for some of the other additive components. The total amount of petroleum based oil used as a diluent in the compositions of the invention will preferably not exceed about 17 percent of the total lubricant by volume.

The synthetic engine lubricants of the invention are preferably formulated so as to meet or exceed the requirements for SAE 5W40 lubricants for gasoline or diesel engines. Such lubricants must have a product viscosity between about 12.9 and 16.7 centistokes (cs) over the requisite temperature range. The lubricants of the invention will desirably have a viscosity ranging between about 14.5 and 16.5 cs, preferably between about 15 and 16 cs, and most preferably, about 15.5 cs. Because the preferred PAO for use in the compositions of the invention has a viscosity substantially lower than that desired for the resultant lubricant, it is necessary to include components having higher viscosities in order to achieve the preferred viscosity for the overall product.

According to one preferred embodiment of the invention, a full PAO synthetic engine lubricant is provided that comprises from about 55 to about 75 volume percent, and more preferably from about 60 to about 70 volume percent, PAO having a viscosity that is preferably from about 6 to about 8 centistokes at 100° C.; from about 5 to about 10 volume percent of a compatible ester or diester compound, preferably having a viscosity of at least about 3.5 cs, that will enhance additive solubility as well as detergency and seal swell performance of the lubricant; a viscosity index improver comprising a sufficient amount of an ethylene-propylene copolymer having a shear stability index of at least about 25, and more preferably from about 27 to 29 or greater, to produce a viscosity ranging from about 14.5 to about 16.5, and more preferably from about 15 to about 16, in the resultant lubricant; from about 12 to about 15 volume percent of a commercially available lubricant additive package such as, for example, Chevron Oronite's OLOA 9061 to insure that the resultant lubricant meets all certification standards for an SAE 5W40 motor oil; sufficient TBN enhancer to raise the TBN of the resultant lubricant to at least 10 and preferably to at least about 12; and, if needed, a minor effective amount of a compatible antifoamant.

A particularly preferred PAO for use in the invention is a hydrogenated copolymer of 1-decene and 1-dodecene. A particularly preferred diester compound for use in the invention is diisodecyl adipate. A particularly preferred TBN enhancer for use in the invention is calcium phenate or calcium sulfonate in a diluent oil. A particularly preferred antifoamant for use in the invention is a silicone fluid such as polydimethyl(siloxane).

According to another preferred embodiment of the invention, a method for lubricating gasoline or diesel engines is disclosed that comprises the steps of providing an engine oil sump substantially devoid of leaks; filling the oil sump to an operational level with an engineered full synthetic oil as disclosed herein; while operating the engine, recirculating the oil through an external filter; periodically monitoring the total base number of the recirculating oil; and injecting into the recirculating oil a sufficient quantity of a TBN enhancer to maintain the TBN at a level of about 12.0.

According to one particularly preferred embodiment of the inventive method, the external oil filter is a centrifugal oil cleaner. According to another preferred embodiment of the invention, the TBN enhancer added to the recirculating oil comprises a high concentration of calcium phenate or calcium sulfonate in a petroleum based diluent oil, or another similarly effective, compatible TBN enhancer. According to yet another preferred embodiment of the invention, the inventive method further comprises the step of periodically monitoring the viscosity of the lubricating oil to determine whether fuel is leaking into the lubricating oil in the sump.

The engineered full PAO synthetic oil disclosed herein is most preferably installed after the engine has been run under load conditions with a mineral oil lubricant for a period sufficient to seat the piston rings. Normally this requires a minimum of 500 hours and, more preferably, about 1,000 or more hours.

The lubricant of the invention exhibits outstanding lubricity and, when used in accordance with the method of the invention, a service life more than five times longer than that experienced with conventional mineral oil lubricants, with significantly diminished health, safety and environmental risks. Furthermore, because the total volume of lubricant required is significantly lower than with mineral oil, the attendant expenses of transportation, storage and waste disposal are also reduced.

DESCRIPTION OF THE PREFERRED EMBODIMENTS

Applicant has discovered that particularly beneficial engine lubricants are made by using as the principal component polyalphaolefin having a viscosity of from about 6 to 8 cs at 100° C. in combination with a compatible olefin copolymer having a shear stability index of at least about 25, a compatible ester or diester compound, a total base number enhancer such as calcium phenate or calcium sulfonate in a diluent oil, a conventional package additive and an optional antifoamant. The engine lubricant compositions of the invention preferably have a viscosity ranging from about 14.5 to about 16.5 cs at 100° C. and a total base number ranging from about 10 to about 12.5. Most preferably, the subject compositions have a viscosity ranging from about 15 to about 16 and a total base number ranging from about 12 to about 12.5. According to a particularly preferred embodiment, the subject lubricants meet all requirements for an SAE 5W40 motor oil and can be used satisfactorily in either gasoline or diesel engines.

The lubricant oil disclosed herein is an engineered, full synthetic lubricant in which the principal ingredient is a hydrogenated polyalphaolefin ("PAO"). PAOs are synthetic hydrocarbon liquids manufactured from the monomer ethylene, $H_2C{=}CH_2$. PAOs have a complex branched structure with an olefin bond in the alpha position of one of the branches. Hydrogenated PAOs have olefin-carbons saturated with hydrogen, which lends excellent thermal stability to the molecule. A preferred hydrogenated PAO for use in the present invention is a copolymer of 1-decene and 1-dodecene having a kinematic viscosity of about seven centistokes at a temperature of about 100° C. that is commercially available from Chevron Phillips.

The preferred PAO for use in the compositions of the invention is a hydrogenated copolymer of 1-decene and 1-dodecene. Applicant has discovered that this PAO, which is believed to consist primarily of 12 carbon chains and has a viscosity of about 7 cs at 100° C., performs particularly well in the lubricant formulations of the invention. PAOs having slightly lower or greater viscosities and, for example, 10 carbon chains are also believed to function similarly, although not as effectively as the most preferred embodiment. This high quality base stock preferably comprises from about 55 to about 75, and more preferably about 60 to 70, volume percent of the lubricant.

Another component, an ester or diester compound that is compatible with the PAO and other components, is desirably added to the lubricant compositions of the invention to supplement the PAO by providing the resultant lubricant with physical properties and characteristics that the PAO alone does not provide. These include, for example, improved additive solubility, detergency and seal swell. Although the ester or diester compound can make up a large percentage of the base stock of the lubricant, amounts ranging from about 5 up to about 10 volume percent are preferred. One particularly preferred ester compound for use in the present invention is diisodecyl adipate. This material is typically very thin, having a viscosity of about 3.5 cs at 100° C., and when mixed with the PAO, further reduces the viscosity of the PAO.

In order to increase the viscosity of the lubricant to a higher level as required for certification as an SAE 5W40 motor oil, a viscous olefin copolymer is desirably added to the PAO and ester. Olefin copolymers having a shear stability index of at least about 25, and more preferably 27 to 29 or greater, are believed to be satisfactory for use in the lubricants of the invention. Preferred olefin copolymers comprise ethylene and propylene, with copolymers having lower ethylene content being more preferred because they are believed to provide more thickening and better solubility. One such particularly preferred copolymer is marketed by Chevron Oronite's under the trade name Paratone 8232, which is believed to comprise an ethylene-propylene copolymer having a viscosity ranging from about 640 to about 680 at 100° C., diluted in mineral oil. The amount of olefin copolymer used in the lubricants of the invention is desirably such that the viscosity of the resultant lubricant will be within a range of from about 14.5 to about 16.5 cs at 100° C., with a range between about 15 and about 16 being most preferred. It is believed that from about 10 to about 15 volume percent of the olefin copolymer is needed to achieve the desired viscosity in the finished lubricant. Generally speaking, if a PAO having a viscosity higher than the preferred viscosity of about 7 cs is used in the subject lubricants, less olefin copolymer is needed to raise the resultant lubricant viscosity to the desired range, whereas use of a PAO having a viscosity lower than 7 cs may necessitate use of a greater amount of olefin copolymer than would otherwise be required.

Even with the outstanding properties afforded by use of the lubricant components described above, the further addition of up to about 15 volume percent of a commercially available lubricant additive package such as those rated in the CH-4 performance category by the American Petroleum Institute may be desirable to further enhance lubricant performance or, in some cases, to bring the overall properties of the resultant lubricant into compliance with the SAE requirements for a 5W40 motor oil. Unlike with many conventional motor oils, where commercially available additive packages are relied upon to boost the properties of lower cost, inferior base stocks, the use of additive packages in the lubricants disclosed herein is primarily for the purpose of further enhancing the already excellent properties of the high quality PAO and ester base stocks.

One additive package believed to be satisfactory for such use is the Chevron Oronite's OLOA 9061. This additive package is believed to comprise effective amounts of polybutene, calcium phenate, calcium sulfonate, zinc dialkyldithiophosphate and molybdenum dithiocarbamate in a diluent oil. The addition of such other desirable additives in the form of a commercially available additive package is believed to facilitate solubility in the other components of the subject lubricant. It should be understood and appreciated, however, that the inventor believes similarly effective results can be achieved by the direct addition of these or other functionally similar, compatible components directly to the compositions of the invention or by premixing such additive components rather than purchasing a premixed additive package.

Even where an additive package is used in the lubricants of the invention, the further addition of a minor effective amount of calcium phenate or calcium sulfonate as a total base number supplement or enhancer is preferred. The TBN enhancer component is desirably added in an amount sufficient to raise the total base number of the resultant lubricant to at least 10, and preferably to a level of 12 or higher. TBN enhancers such as calcium phenate or calcium sulfonate are typically diluted in mineral oil prior to introducing the enhancer into the other components of the subject motor oil lubricant. In neat form, calcium phenate can have a TBN of about 250. One preferred, commercially available product useful as a TBN enhancer is Chevron Oronite's OLOA 2954U. According to one particularly preferred embodiment of the invention, up to about one volume percent of the TBN enhancer is added to the compositions of the invention.

Another optional additive that is needed or desirable where the other components foam to a greater extent than desired during use is an antifoamant such as, for example, polydimethyl(siloxane). Polydimethyl(siloxane) is a silicone fluid that is commercially available, for example, as Dow Corning® 200, which is believed to have a viscosity of about 1000 cs at 100° C. According to one particularly preferred embodiment of the invention, for sake of illustration, about 46 drops polydimethyl(siloxane) is added to about 100 gallons of the subject lubricant to control foaming.

A method for lubricating an engine is also disclosed herein that preferably comprises the steps of providing an engine with an oil recirculation system substantially devoid of leaks; filling the oil recirculation system to an operational level with an engineered full synthetic oil having a viscosity ranging from about 14.5 to about 16.5, said fully synthetic oil comprising from about 55 to about 75 volume percent polyalphaolefin having a viscosity from about 6 to about 8 cs, and most preferably about 7 cs, at 100° C. and having an initial total base number ranging between about 10 and about 12.5; thereafter periodically monitoring the total base number of the engine oil to determine whether the TBN has dropped below 10, and adding sufficient total base number enhancer to raise the TBN back above 10, and most preferably above 12. According a particularly preferred embodiment, the method of the invention comprises the additional steps of recirculating the oil through an external filter while operating the engine; periodically monitoring the total base number of the recirculating oil; and injecting into the recirculating oil a sufficient quantity of a total base number enhancer to raise the total base number to a level of about 12.0. Centrifugal separators are particularly preferred for use for filtering the lubricant of the invention, particularly when the lubricant is used in large, heavy duty engines. Preferred TBN enhancers for use in the method of the invention include calcium phenate or calcium sulfonate, either of which is preferably premixed with a mineral oil diluent prior to being added to the recirculating oil.

The engine lubricant of the invention exhibits superior performance in both gasoline and diesel engines, and is particularly preferred for large diesel engines used in oil field or other heavy industrial applications where they are operated for long periods under heavy loads. The disclosed lubricant costs more per gallon than mineral oil or blended synthetic oils due to the high quality of its components and should not be used in engines that are known to have oil leaks. With new or rebuilt engines, the oil of the invention is preferably not installed until the engine has been run under load conditions with a mineral oil lubricant for a period sufficient to seat the piston rings. Normally this requires a minimum of 500 hours and more preferably about 1,000 or more hours.

During use, the viscosity of the subject lubricating oil should be checked periodically to monitor dilution and insure that fuel is not leaking into the oil sump. An oil analysis should be done monthly, as with conventional lubricating oils, and the total base number of the oil should also be monitored at least monthly, preferably staggering the oil analysis with the TBN analysis on a bi-weekly basis.

When the TBN of the oil drops below 12.0, a sufficient amount of a suitable TBN enhancer as discussed above is added to the oil to raise the TBN back to 12. The amount of TBN enhancer required to raise the TBN to 12.0 or higher during use of the lubricant will depend upon the total base number as tested, the particular enhancer, and the concentration of the enhancer in the diluent oil. The TBN enhancer is preferably injected into the recirculating oil stream in small quantities over a period that is adequate to facilitate distribution of the enhancer throughout the oil in the sump.

According to a particularly preferred embodiment of the method of the invention, the TBN enhancer is injected into the oil stream as it exits from a centrifugal filter that is installed in an external recirculation loop through which oil is pumped continuously during engine operation. This recirculation loop also desirably contains a metal detection system capable of removing entrained metal particles from the used oil. Most preferably, the metal detection system is installed between the recirculation pump and the oil filter.

Through use of the engine lubricant disclosed herein in accordance with the method of the invention, one can achieve efficiencies and savings that make the incremental cost of the lubricant over conventional lubricants inconsequential. Use of the subject lubricant will reduce the amount of oil consumed during engine operation by at least 2.5 to 3 times; will increase the service life of the lubricant by up to five times, thereby also reducing the associated labor, freight, handling and waste removal costs; will reduce the number of required oil filter changes by 50 percent; will reduce the risk of oil spillage; and will typically reduce expenses associated with major overhauls and downtime by at least about 50 percent. Even if one assumes an initial lubricant cost that is four times higher than that of conventional motor oils, the cost savings achievable in operating a diesel engine having an oil sump containing 120 gallons of lubricant for 5,000 hours when using the lubricant disclosed herein range between 40 and 50 percent over conventional motor oils. These savings are further increased when one considers reductions in long-term maintenance requirements, fuel savings achievable through use of a better engine lubricant, and reduced risk of spillage and personal injury arising from transportation and handling of lubricants.

Other alterations and modifications of the invention will likewise become apparent to those of ordinary skill in the art upon reading the present disclosure, and it is intended that the scope of the invention disclosed herein be limited only by the broadest interpretation of the appended claims to which the inventor is legally entitled.

What is claimed is:

1. An engine lubricant comprising from about 55 to about 75 volume percent polyalphaolefin having a viscosity between about 6 and 8 centistokes at 100° C.; from about 5 to about 10 volume percent of a compound that is compatible with the polyalphaolefin and is selected from esters and diesters having a viscosity of at least about 3.5 cs at 100° C.; a sufficient amount of an ethylene-propylene copolymer having a shear stability index of at least about 25 to produce a resultant lubricant viscosity ranging from about 14.5 to about 16.5 cs at 100° C.; and sufficient total base number enhancer to raise the total base number of the resultant lubricant to at least 10.

2. The engine lubricant of claim 1, comprising from about 60 to about 70 volume percent polyalphaolefin.

3. The engine lubricant of claim 1 wherein the polyalphaolefin is a hydrogenated copolymer of decene and dodecene and has a viscosity of about 7 cs at 100° C.

4. The engine lubricant of claim 1 wherein the compound selected from esters and diesters is diisodecyl adipate.

5. The engine lubricant of claim 1 wherein the ethylene-propylene copolymer has a shear stability index of at least about 27.

6. The engine lubricant of claim 5 wherein the ethylene-propylene copolymer has a shear stability index ranging from about 27 to about 29.

7. The engine lubricant of claim 1 comprising sufficient ethylene-propylene copolymer to produce a lubricant having a viscosity ranging from about 15 to about 16 cs at 100° C.

8. The engine lubricant of claim 1 comprising sufficient total base number enhancer to raise the total base number of the resultant lubricant to at least about 12.

9. The engine lubricant of claim 1 wherein the total base number enhancer is selected from the group consisting of calcium phenate and calcium sulfonate.

10. The engine lubricant of claim 1 wherein the total base number enhancer further comprises a diluent oil.

11. The engine lubricant of claim 1, further comprising a sufficient quantity of a commercially available engine lubricant additive package to insure that the resultant lubricant meets all certification standards for an SAE 5W40 motor oil.

12. The engine lubricant of claim 11 wherein the additive package is added in an amount ranging from about 12 to about 15 volume percent of the resultant lubricant.

13. The engine lubricant of claim 11 wherein the additive package comprises components selected from the group consisting of polybutene, calcium phenate, calcium sulfonate, zinc dialkyldithiophosphate, molybdenum dithiocarbamate and diluent oil.

14. The engine lubricant of claim 1, further comprising a minor effective amount of a compatible antifoamant.

15. The engine lubricant of claim 14 wherein the antifoamant is a silicone fluid.

16. The engine lubricant of claim 15 wherein the antifoamant is polydimethyl(siloxane).

17. The engine lubricant of claim 16 wherein the polydimethyl(siloxane) is added to the lubricant in an amount of about 46 drops per 100 gallons of lubricant.

18. An engine lubricant comprising from about 60 to about 70 volume percent of a polyalphaolefin copolymer of decene and dodecene having a viscosity of about 7 cs at 100° C.; from about 5 to about 10 volume percent of a compound consisting of an ester or diester that is compatible with the polyalphaolefin; a sufficient amount of an ethylene-propylene copolymer having a shear stability index of at least about 25 to produce a viscosity in the resultant lubricant ranging from about 14.5 to about 16.5 cs at 100° C.; a sufficient amount of a commercially available lubricating oil additive package to bring the resultant lubricant into compliance with SAE 5W40 specifications; and sufficient total base number extender to produce a total base number of at least 10 in the resultant lubricant.

19. The engine lubricant of claim 18, further comprising a minor effective amount of an antifoamant.

20. The engine lubricant of claim 18 comprising diisodecyl adipate.

21. The engine lubricant of claim 18 comprising calcium phenate.

22. The engine lubricant of claim 18 comprising calcium sulfonate.

23. The engine lubricant of claim 19 comprising polydimethyl(siloxane).

24. The engine lubricant of claim 18 comprising polybutene.

25. The engine lubricant of claim 18 comprising zinc dialkyldithiophosphate.

26. The engine lubricant of claim 18 comprising molybdenum dithiocarbamate.

27. The engine lubricant of claim 18 comprising diluent oil.

28. The engine lubricant of claim 27 wherein the diluent oil is a petroleum based oil.

29. The engine lubricant of claim 18 comprising about 64 volume percent polyalphaolefin; about 14 volume percent of an additive package including a compatible carrier, a phenate, a sulfonate, a dithiophosphate, a dithiocarbamate and diluent oil; about 12 volume percent ethylene-propylene copolymer; about 10 volume percent diisodecyl adipate; about 1 volume percent total base number extender; and a minor effective amount of an antifoamant.

30. The engine lubricant of claim 29 wherein the ethylene/propylene copolymer has a viscosity ranging from about 640 to about 680 cs at 100° C.

31. A method for lubricating an engine, comprising the steps of providing an engine with an oil recirculation system; filling the oil recirculation system to an operational level with a full PAO synthetic engine oil having a viscosity ranging from about 14.5 to about 16.5 cs at 100° C., said engine oil comprising from about 55 to about 75 volume percent polyalphaolefin having a viscosity from about 6 to about 8 cs. at 100° C. and having an initial total base number ranging between about 10 and about 12.5; operating the engine while recirculating the engine oil; periodically monitoring the total base number of the engine oil to determine whether the total base number of oil has dropped below 10; and adding to the engine oil a sufficient amount of a total base number enhancer to raise the total base number to a level above 10.

32. The method of claim 31 wherein the oil is recirculated through an external oil filter that utilizes centrifugal separation.

33. The method of claim 31 wherein a sufficient amount of total base number enhancer is added to the engine oil to raise the total base number to a level above 12.

34. The method of claim 31 wherein the total base number enhancer is selected from the group consisting of calcium phenate and calcium sulfonate.

35. The method of claim 31 wherein the total base number enhancer is diluted in mineral oil.

36. The method of claim 31 comprising the additional step of periodically monitoring the viscosity of the lubricating oil.

* * * * *